US012331612B2

(12) United States Patent
Evers et al.

(10) Patent No.: US 12,331,612 B2
(45) Date of Patent: Jun. 17, 2025

(54) SHIFTING SLEEVE TIEBACK SEAL SYSTEM

(71) Applicant: Halliburton Energy Services, Inc., Houston, TX (US)

(72) Inventors: Rutger Evers, Singapore (SG); Daniel Newton, Singapore (SG); Brandon T. Least, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 48 days.

(21) Appl. No.: 18/241,594

(22) Filed: Sep. 1, 2023

(65) Prior Publication Data

US 2024/0084666 A1 Mar. 14, 2024

Related U.S. Application Data

(60) Provisional application No. 63/405,607, filed on Sep. 12, 2022.

(51) Int. Cl.
*E21B 33/12* (2006.01)
*E21B 23/06* (2006.01)
*E21B 43/10* (2006.01)

(52) U.S. Cl.
CPC ..... *E21B 33/1208* (2013.01); *E21B 23/06* (2013.01); *E21B 43/10* (2013.01)

(58) Field of Classification Search
CPC ..... E21B 33/1208; E21B 23/06; E21B 43/10; E21B 43/103; E21B 33/1212; E21B 33/127; E21B 23/01; E21B 23/00
See application file for complete search history.

(56) References Cited

U.S. PATENT DOCUMENTS 3,918,523 A * 11/1975 Stuber ..... E21B 33/14 166/292
8,499,843 B2 * 8/2013 Patel ..... E21B 33/1277 166/387

(Continued)

OTHER PUBLICATIONS

International Search Report and Written Opinion for International Patent Application No. PCT/US2023/032038 dated Jan. 4, 2024. PDF file. 9 pages.

(Continued)

*Primary Examiner* — Daniel P Stephenson
(74) *Attorney, Agent, or Firm* — Scott Richardson; C. Tumey Law Group PLLC

(57) ABSTRACT

A shifting sleeve tieback seal system may include a body portion and a swellable material disposed about a circumference of the body portion. The swellable material is configured to expand in response to exposure to wellbore fluids. Further, the system may include an upper end ring disposed in a position axially above the swellable material, a lower end ring disposed in a position axially below the swellable material, and a sleeve disposed radially outward from the swellable material and sealed against the upper end ring and/or the lower end ring in a run-in position to isolate the swellable material from wellbore fluids. The sleeve is configured to contact a downhole feature in a setting position and contact with the downhole feature is configured to move the sleeve to expose the swellable material to wellbore fluids such that the swellable material expands to seal against a downhole tubular.

19 Claims, 6 Drawing Sheets

(56) References Cited

U.S. PATENT DOCUMENTS

| | | | | |
|---|---|---|---|---|
| 10,358,888 | B2 * | 7/2019 | Al-Abduljabbar | E21B 33/12 |
| 10,961,804 | B1 * | 3/2021 | Fripp | E21B 33/1208 |
| 11,761,293 | B2 * | 9/2023 | Least | E21B 33/1208 166/285 |
| 2008/0149351 | A1 * | 6/2008 | Marya | E21B 33/1208 166/387 |
| 2010/0139930 | A1 | 6/2010 | Patel et al. | |
| 2016/0010411 | A1 | 1/2016 | Al-Rabeh | |
| 2018/0087350 | A1 * | 3/2018 | Sherman | C08K 3/08 |
| 2018/0355693 | A1 | 12/2018 | Al-AbdulJabbar et al. | |
| 2019/0128074 | A1 * | 5/2019 | Stokes | E21B 33/12 |
| 2020/0370391 | A1 * | 11/2020 | Fripp | E21B 33/1277 |
| 2021/0189817 | A1 * | 6/2021 | Fripp | E21B 23/01 |
| 2021/0189830 | A1 | 6/2021 | Greci et al. | |
| 2022/0186578 | A1 | 6/2022 | Least et al. | |
| 2022/0341280 | A1 | 10/2022 | Holderman et al. | |
| 2024/0084666 | A1 * | 3/2024 | Evers | E21B 33/1208 |
| 2024/0287876 | A1 * | 8/2024 | Karakaya | E21B 43/10 |

OTHER PUBLICATIONS

Netherlands Office Action for NL Patent Application No. 2035756 dated Dec. 11, 2023. PDF file. 8 pages.

* cited by examiner

SHIFTING SLEEVE TIEBACK SEAL SYSTEM

CROSS-REFERENCE TO RELATED APPLICATIONS

The present application is a non-provisional conversion of U.S. Provisional Application Ser. No. 63/405,607, filed Sep. 12, 2022, which is herein incorporated by reference in its entirety.

BACKGROUND

In some wellbore operations, one or more liner tiebacks may be run-in-hole. The liner tiebacks may be run-in-hole to improve flow of production fluid (e.g., hydrocarbons). That is, having a smaller diameter, via the liner tieback, for the flow of production fluid may increase the flow velocity of the production fluid. Traditionally, liner tiebacks are sealed downhole to a liner hanger. However, for large bore liner hangers, getting a reliable tie-back seal is often challenging because the relatively large diameter of the pistons of a tieback seal system may not be flush with an inner diameter of the liner hanger. To address this issue, non-piston tieback seals may instead be run-in-hole. Some of these tieback seals may be configured to expand in response to contact with wellbore fluids. Unfortunately, these tieback seals may expand prematurely (i.e., before the reaching the liner hanger) in the wellbore.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein is a shifting sleeve tieback seal system configured to form a seal with a corresponding liner hanger, liner, and/or casing positioned proximate the liner hanger. As set forth in detail below, the shifting sleeve tieback seal system includes at least one sleeve that covers a swellable packer material. Indeed, the sleeve prevents fluid from the wellbore from contacting the swellable packer material such that the swellable packer material does not expand prematurely as the tool (e.g., shifting sleeve tieback seal system) is run-in-hole. As the tool reaches the corresponding liner hanger, liner, and/or casing, contact between the tool and the liner hanger and/or other downhole feature with suitable geometry may actuate the sleeve and expose the swellable packer material to the wellbore such that swellable packer material may react and expand to form a seal (e.g., tieback seal) at the corresponding liner hanger, liner, and/or casing proximate the liner hanger.

Figure 1:
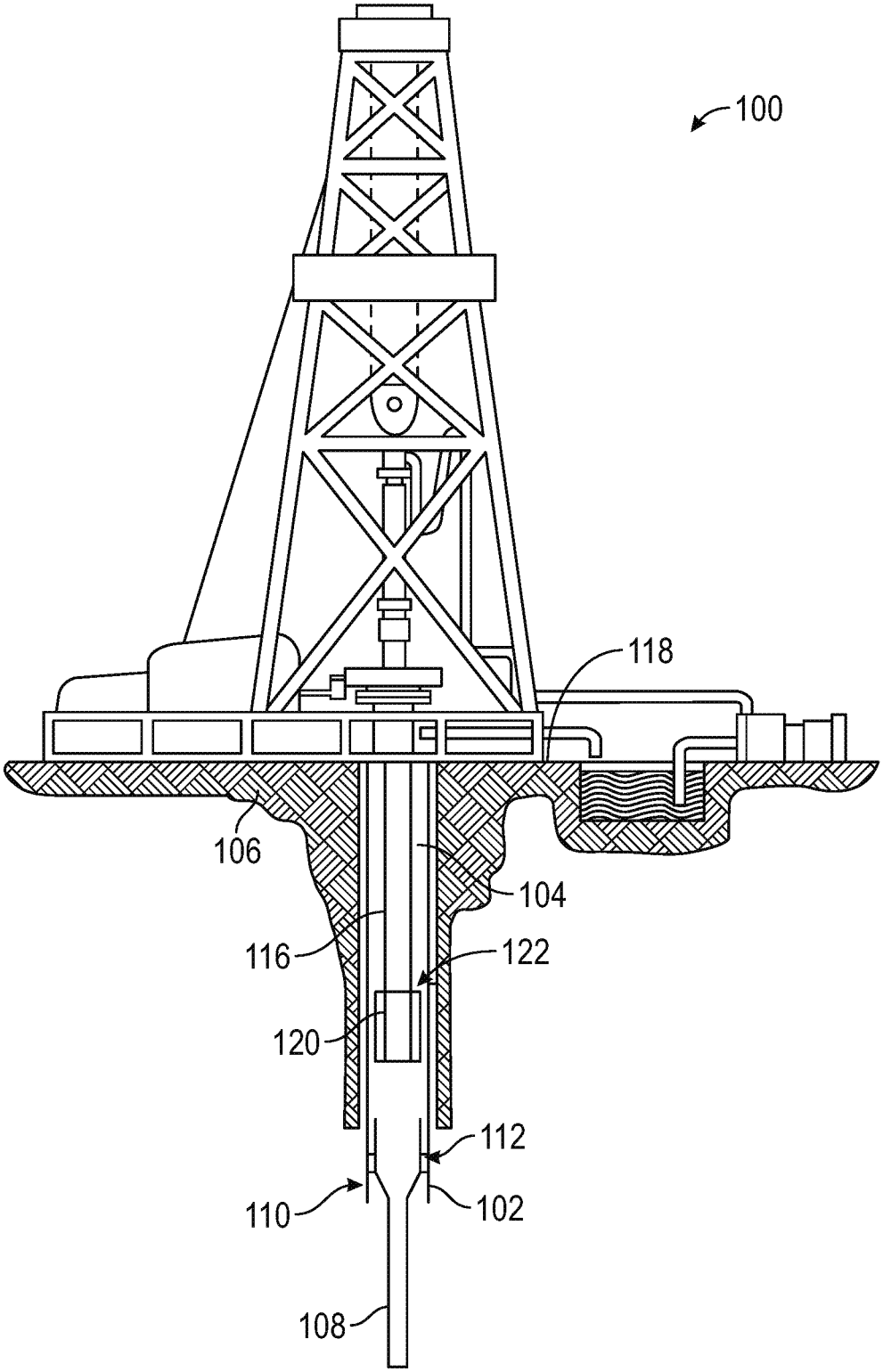
FIG. 1 illustrates a wellbore completion system, in accordance with some embodiments of the present disclosure.

FIG. 1 illustrates a wellbore completion system, in accordance with some embodiments of the present disclosure. As illustrated, the wellbore completion system 100 may include a casing 102 (e.g., casing string) set within a borehole (e.g., wellbore 104). In particular, the casing 102 may be run-in-hole to a desired position during completion operations. Once in position, the casing 102 may be cemented or otherwise secured in place. The casing 102 may support surrounding downhole formations 106 during production operations. Further, the casing 102 may provide a flow path for production fluid (e.g., hydrocarbons) along the wellbore 104. Moreover, as illustrated, a liner 108 may be secured to a downhole end 110 of the casing 102 via a liner hanger 112. That is, the liner 108 may be hung from the casing 102 such that the liner 108 extends downhole from the downhole end 110 of the casing 102. The liner 108 may extend the flow path for production fluid (e.g., hydrocarbons) along the wellbore 104. During completion operations, the production fluid may flow up through the liner 108, the casing 102, and/or additional tubulars to the surface. The terms "liner," "casing," and "tubular" are used generally to describe tubular wellbore items, used for various purposes in wellbore operations. Liners 108, casings 102, and tubulars can be made from various materials (metal, plastic, composite, etc.), that can be expanded or unexpanded as part of an installation procedure and can be segmented or continuous. It is not necessary for the liner 108 or the casing 102 to be cemented into position. Further, any type of liner, casing, or tubular may be used in keeping with the principles of the present invention.

Further, a liner tieback 116 may be run-in-hole through the casing 102 to the liner hanger 112 and/or the liner 108 to help improve flow of production fluid (e.g., hydrocarbons) through the casing 102 and/or other tubulars. In particular, the liner tieback 116 may be sealed to the liner hanger 112, liner 108, and/or casing 102 proximate the liner hanger 112 such that the production fluid flowing up from the liner 108 may flow through the liner tieback 116 instead of through the casing 102. As illustrated, the liner tieback 116 has a smaller diameter than the casing 102, which may improve the flow of production fluid to the surface 118. Moreover, the liner tieback 116 may be configured to seal to the liner hanger 112, liner 108, and/or casing 102 via a shifting sleeve tieback seal system 120 disposed at a lower end 122 of the liner tieback 116. As set forth in detail below, the shifting sleeve tieback seal system 120 includes at least one sleeve that covers a swellable material (e.g., swellable packer material), which expands in response to exposure to wellbore fluid (shown in FIG. 2A). The sleeve prevents wellbore fluid from contacting the swellable material such that the swellable material does not expand prematurely as the tool (e.g., shifting sleeve tieback seal system 120) is run-in-hole. As the tool 120 reaches the liner hanger 112, liner 108, and/or casing 102 proximate the liner hanger 112, contact between the tool 120 and a downhole feature (e.g., the liner hanger 112, the liner 108, and/or another feature with suitable geometry) may actuate the sleeve and expose the swellable material to the wellbore 104 such that swellable material may react and expand to form a seal (e.g., tieback seal) at the liner hanger 112, liner 108, and/or casing 102 (shown in FIGS. 2B, 3B, and 4C).

Figure 2A:
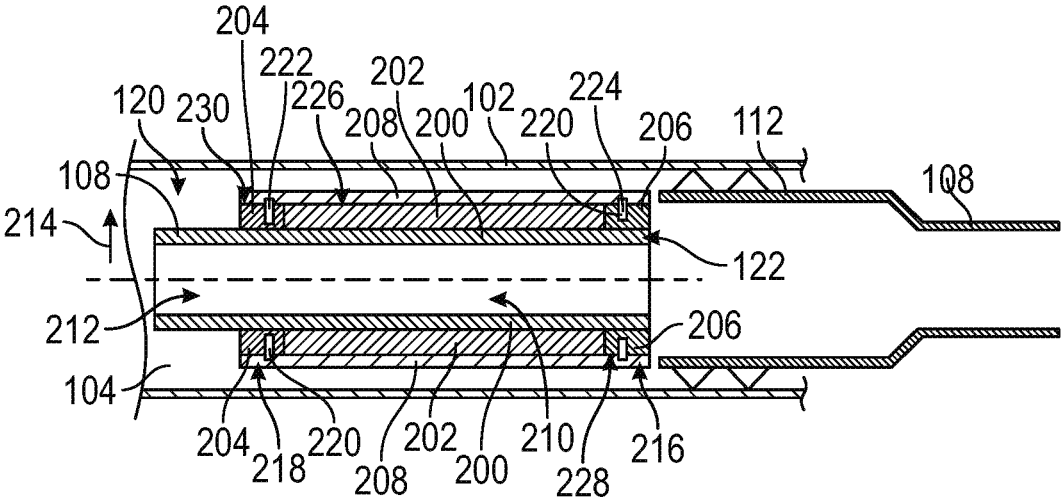
FIGS. 2A-2B illustrate cross-sectional views of a shifting sleeve tieback seal, in accordance with some embodiments of the present disclosure.
Figure 2B:
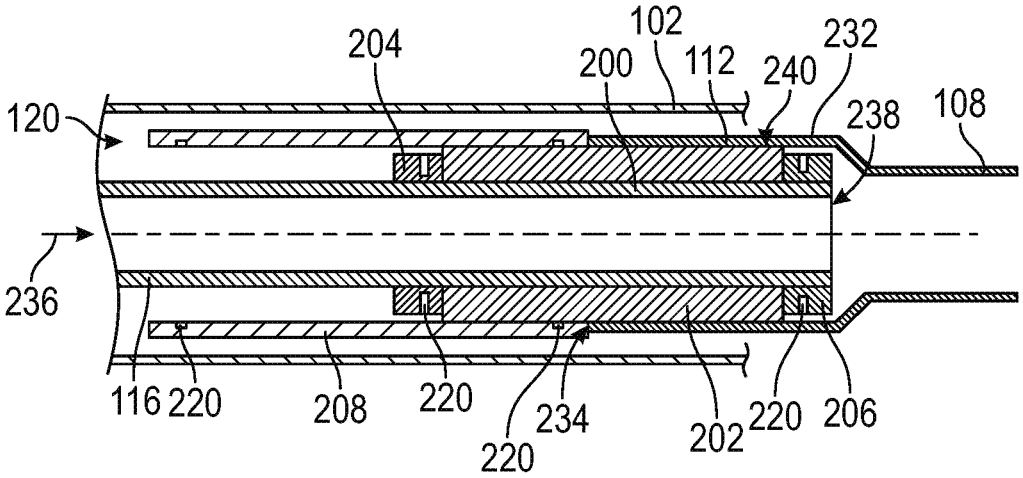

FIGS. 2A-2B illustrate cross-sectional views of a shifting sleeve tieback seal system in a run-in position and set position, respectively, in accordance with some embodiments of the present disclosure. As illustrated in FIG. 2A, the shifting sleeve tieback seal system 120 comprises a body portion 200 (e.g., a cylindrical body) having a swellable material 202 disposed about a circumference of the body portion 200. In particular, the swellable material 202 may be disposed between an upper end ring 204 and a lower end ring 206, which are each disposed about the body portion 200. The upper end ring 204 may be positioned uphole from the lower end ring 206. Further, the upper end ring 204 and the lower end ring 206 may be configured to support the swellable material 202 (e.g., restrain axial movement of the swellable material 202 with respect to the body portion 200) as the shifting sleeve tieback seal system 120 is run-in-hole and secured in the set position. As set forth above, the swellable material 202 may be configured to expand in response to exposure to wellbore fluids. The upper end ring 204 and the lower end ring 206 may restrain expansion of the swellable material 202 in axial directions such that the swellable material 202 may expand further in a radial direction. However, the shifting sleeve tieback seal system 120 may also include a sleeve 208 configured to isolate the swellable material 202 from the wellbore fluid in the run-in position to prevent the swellable material 202 from prematurely expanding in the wellbore 104. As set forth in greater detail below, the sleeve 208 may be displaced in the set position such that the swellable material 202 may expand to seal the shifting sleeve tieback seal system 120 against a corresponding liner hanger 112, liner 108, and/or casing 102 disposed proximate the liner hanger 112.

Moreover, as illustrated, the body portion 200 may comprise the lower end 122 of the liner tieback 116. That is, the lower end of the liner tieback 116 may be the body portion 200 of the shifting sleeve tieback seal system 120 such that the swellable material 202 may be disposed about the lower end of the liner tieback 116. Alternatively, the body portion 200 may be a separate body secured to the lower end of the liner tieback 116. For example, the lower end of the liner tieback 116 and the shifting sleeve tieback seal system 120 may have corresponding threads such that the shifting sleeve tieback seal system 120 may be threaded into the lower end of the liner tieback 116. Additionally, the body portion 200 (e.g., the cylindrical body) is hollow such that production fluids (e.g., hydrocarbons) may flow through a central tool bore 210 of the body portion 200 and a central tieback bore 212 of the liner tieback 116 to the surface 118 (shown in FIG. 1) during production operations.

Further, as set forth above, the swellable material 202 may be configured to expand in response to exposure to wellbore fluids. In particular, the swellable material 202 may be configured to expand in response to a chemical reaction between the swellable material 202 and the fluid in the wellbore 104. That is, the swellable material 202 may comprise a particular metal alloy material configured to undergo a chemical reaction in response to exposure to downhole fluids. The chemical reaction may cause the metal alloy material to transform into a rock-like material. As the metal alloy material transforms into the rock-like material, the swellable material 202 may expand. The swellable material 202 may expand in the radially outward direction due at least in part to the upper end ring 204 and the lower end ring 206 restraining axial expansion of the swellable material 202. The swellable material 202 may include any suitable alloy configured to expand in response to exposure to the downhole fluids. Alternatively, the swellable material 202 may be configured to expand in response to absorbing fluid (e.g., water, hydrocarbons, etc.) from the wellbore 104. For example, the swellable material 202 may comprise a swellable elastomer seal configured to absorb downhole fluid. As the swellable elastomer seal absorbs the downhole fluid, the swellable elastomer seal may increase in volume. The increase in volume may cause the swellable elastomer seal to expand in a radially outward direction 214.

As set forth above, the shifting sleeve tieback seal system 120 may further include the sleeve 208 configured to enclose the swellable material 202 in the run-in position to prevent the swellable material 202 from prematurely expanding in the wellbore 104. As illustrated, in the run-in position, a lower end 216 of the sleeve 208 is secured to the lower end ring 206 and an upper end 218 of the sleeve 208 is secured to the upper end ring 204 to seal the swellable material 202 from the wellbore 104. In particular, the sleeve 208 may be secured to the lower end ring 206 and the upper end ring 204 via at least one fastener 220. Alternatively, the sleeve 208 may only be secured to either the lower end ring 206 or the upper end ring 204 via the at least one fastener 220. That is, the sleeve 208 may only be secured to the shifting sleeve tieback seal system 120 at one location via the at least one fastener 220. However, the sleeve 208 may alternatively be secured, via the at least one fastener 220, at multiple locations along the length of the sleeve 208 and may be secured to any suitable portion of the shifting sleeve tieback seal system 120.

Moreover, the at least one fastener 220 may restrain axial and/or radial movement of the sleeve 208 with respect to the lower end ring 206 and the upper end ring 204 such that the seal between the sleeve 208 and the end rings (e.g., the upper end ring 204 and the lower end ring 206) may be maintained as the shifting sleeve tieback seal system 120 is run-in-hole. The at least one fastener 220 may include at least one shear pin. For example, at least one upper shear pin 222 may secure the sleeve 208 to the upper end ring 204 and/or at least one lower shear pin 224 may secure the sleeve 208 to the lower end ring 206. However, any suitable fasteners may be used to temporarily restrain axial and/or radial movement of the sleeve 208 with respect to the end rings 204, 206 as the shifting sleeve tieback seal system 120 is run-in-hole.

Moreover, as set forth above, the lower end ring 206 may be disposed about the body portion 200 in a position below the swellable material 202 and the upper end ring 204 may be disposed about the body portion 200 in a position above the swellable material 202. As illustrated, respective radially inner surfaces of the lower end ring 206 and the upper end ring 204 may be sealed to the body portion 200. Further, the sleeve 208 (e.g., metal sleeve), may have a tubular shape that may be disposed about the end rings 204, 206 and the body portion 200 to enclose the swellable material 202. As such, the sleeve 208 may at least extend axially from the lower end ring 206 to the upper end ring 204 about circumference of the body portion 200. Indeed, an inner surface 226 of the sleeve 208 at the lower end 216 of the sleeve 208 is configured to interface (e.g., seal) with a radially outer surface 228 of the lower end ring 206, and the inner surface 226 of the sleeve 208 at the upper end 218 of the sleeve 208 is configured to interface (e.g., seal) with a radially outer surface 230 of the upper end ring 204 such that the sleeve 208 may seal the swellable material 202 from the wellbore 104 in the run-in position.

FIG. 2B discloses the shifting sleeve tieback seal system 120 in the set position. As set forth above, the shifting sleeve tieback seal system 120 may be run-in-hole during completion operations to form a seal (e.g., tieback seal) with a downhole tubular 232 (e.g., the liner hanger 112, the liner 108, the casing 102, etc.) such that production fluid may flow from the liner 108, into the liner tieback 116, and to the surface 118 (shown in FIG. 1). As illustrated, in the set position, the swellable material 202 may expand to contact and form a seal against the liner hanger 112. However, the swellable material 202 may alternatively, or additionally, expand at the set position to contact and form a seal against the liner 108 and/or the casing 102.

Moreover, to form the tieback seal, the sleeve 208 of the shifting sleeve tieback seal system 120 may be displaced in the set position such that the swellable material 202 may expand. As illustrated, the sleeve 208 may have a similar diameter to a top of the liner hanger 112 (e.g., a polished bore receptacle) such that the sleeve 208 may be radially aligned with the liner hanger 112 as the shifting sleeve tieback seal system 120 is run-in-hole. Accordingly, as the tool (e.g., shifting sleeve tieback seal system 120) moves axially downhole toward the set position (as shown), the sleeve 208 first contacts a top surface 234 of the liner hanger 112 in a setting position. Such contact with the liner hanger 112 may move/displace the sleeve 208 to expose the swellable material 202 to wellbore fluids such that the swellable material 202 may expand and seal against the downhole tubular 232 (e.g., the liner hanger 112, liner 108, and/or casing 102).

In particular, the contact between the sleeve 208 and the top surface 234 of the liner hanger 112 may prevent the sleeve 208 from moving further in an axially downhole direction 236 with respect to the liner hanger 112. However, the weight on the shifting sleeve tieback seal system 120, at least in part from the weight of the liner tieback 116, may drive the body portion 200, the swellable material 202, the lower end ring 206, and the upper end ring 204 of the shifting sleeve tieback seal system 120 in the axially downhole direction 236 with respective to the liner hanger 112. As such, the weight on the tool may shear the at least one fastener 220 (e.g., shear pins) securing the sleeve 208 to the end rings 204, 206 such that the sleeve 208 detaches from the end rings 204, 206. With the sleeve 208 detached, the body portion 200, the end rings 204, 206, and the swellable material 202 may move axially downhole with respect to the sleeve 208 due to the weight on the tool. As illustrated, the body portion 200, the end rings 204, 206, and the swellable material 202 may move axially downhole into a central liner hanger bore 238 of the liner hanger 112. Further, with the sleeve 208 displaced, the swellable material 202 may be exposed to the wellbore 104 (e.g., wellbore fluids). As the swellable material 202 reacts with the wellbore fluids, the swellable material 202 is configured to expand such that a radially outer surface 240 of the swellable material 202 contacts and forms a seal against the liner hanger 112.

Figure 3A:
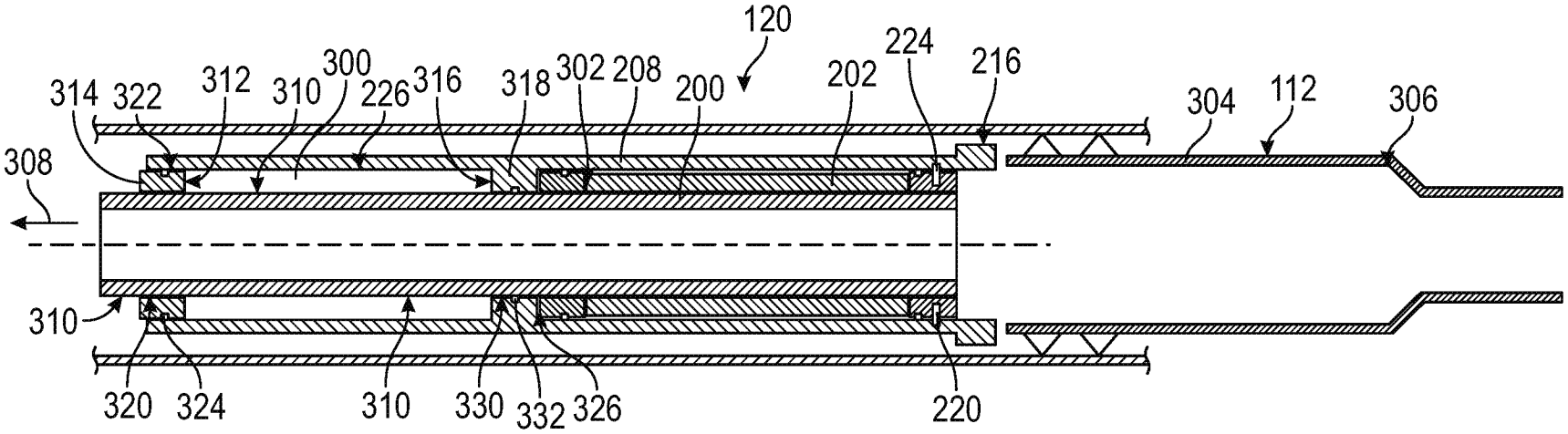
FIGS. 3A-3B illustrate cross-sectional views of a shifting sleeve tieback seal system having a hydrostatic assist chamber, in accordance with some embodiments of the present disclosure.
Figure 3B:
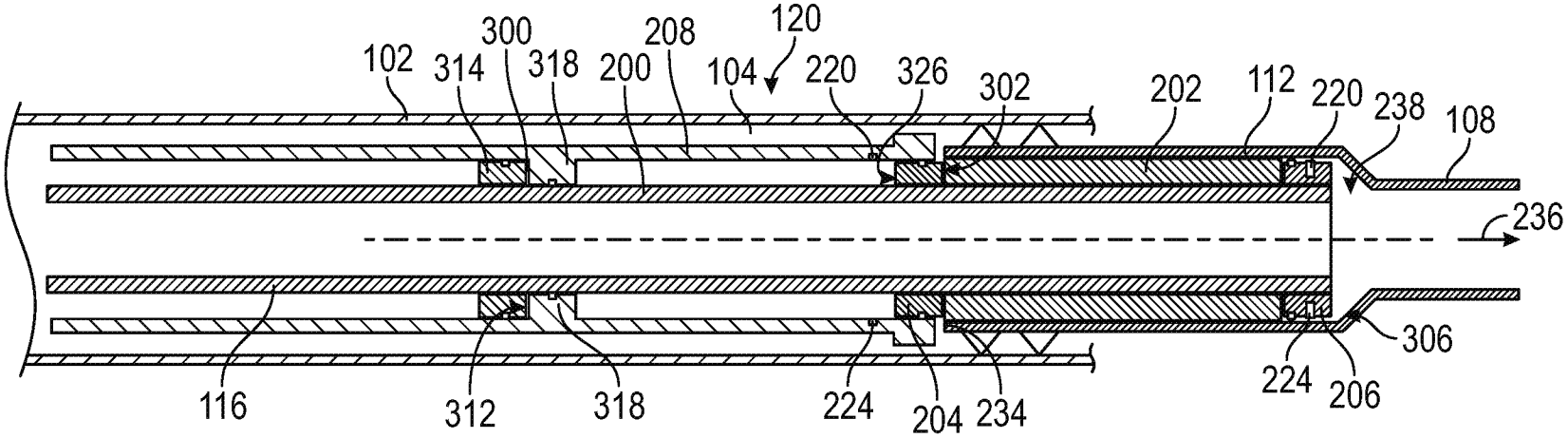

FIGS. 3A-3B illustrate cross-sectional views of a shifting sleeve tieback seal system having a hydrostatic assist chamber, in accordance with some embodiments of the present disclosure. In particular, FIG. 3A illustrates the shifting sleeve tieback seal system 120 with a hydrostatic assist chamber 300 ("chamber") disposed in the run-in-position. The chamber 300 is configured to provide a biasing force to help fully stroke the sleeve 208 from the run-in position to a stroked position. Specifically, the chamber 300 is configured to help fully stroke the sleeve 208 such that the lower end 216 of the sleeve 208 is shifted from a position radially outward and axially aligned with the swellable material 202 (e.g., the run-in position) to a position axially uphole from an upper end 302 of the swellable material 202 (e.g., the stroked position). In some embodiments, the swellable material 202 may have a greater axial length than the polished bore receptacle 304 of the liner hanger 112. As such, the shifting sleeve tieback seal system 120 may bottom out at the downhole end 306 of the polished bore receptacle 304 before the sleeve 208 is fully stroked. The hydrostatic assist chamber 300 may be configured to drive the sleeve 208 in an axially uphole direction 308, with respect to the body portion 200, to the fully stroked position in response to shearing of the at least one fastener 220 (e.g., the at least one lower shear pin 224). Further, after the at least one fastener 220 is sheared, the hydrostatic assist chamber 300 may be configured to fully stroke the sleeve 208 without additional forces generated by contact between the sleeve 208 and the liner hanger 112 and/or another suitable downhole feature.

The hydrostatic assist chamber 300 may be configured to house a compressible fluid (e.g., air) at atmospheric pressure. As illustrated, the chamber 300 may be disposed axially above the swellable material 202 and radially between the sleeve 208 and the body portion 200. For example, the chamber 300 may be defined by a radially inner surface 226 of the sleeve 208, a radially outer surface 310 of the body portion 200, a downhole surface 312 of an upper chamber ring 314, and an uphole surface 316 of a sleeve wall 318. The upper chamber ring 314 is disposed about the body portion 200 in a position axially uphole from the upper end ring 204. The upper chamber ring 314 may be rigidly secured to the body portion 200 such that the upper chamber ring 314 maintains a fixed distance from the upper end ring 204 during operation. For reasons set forth in greater detail below, the stroke length of the sleeve 208 from the run-in position to the stroked position may be based at least in part on the distance between the upper end ring 204 and the upper chamber ring 314. Further, a radially inner surface 320 of the upper chamber ring 314 may be secured against the radially outer surface 310 of the body portion 200 such that the upper chamber ring 314 is sealed against the body portion 200 to prevent the compressible fluid from flowing out of the chamber 300. Additionally, a radially outer surface 322 of the upper chamber ring 314 may be sealed against the radially inner surface 226 of the sleeve 208 to prevent the compressible fluid from flowing out of the chamber 300. In particular, the shifting sleeve tieback seal system 120 may include at least one upper chamber ring seal 324 secured to the radially outer surface 322 of the upper chamber ring 314. As set forth in greater detail below, the sleeve 208 may be configured to move axially with respect to the upper chamber ring 314. The at least one upper chamber ring seal 324 may be configured to contact the radially inner surface 226 of the sleeve 208 to maintain a seal between the upper chamber ring 314 and the sleeve 208 as the sleeve 208 moves with respect to the upper chamber ring 314.

Moreover, the sleeve 208 may include the sleeve wall 318, which protrudes radially inward from the radially inner surface 226 of the sleeve 208 about the circumference of the sleeve 208. That is, the sleeve wall 318 may extend radially inward from the radially inner surface 226 of the sleeve 208 to form a ring about the radially inner sleeve surface 226. The sleeve wall 318 may be disposed adjacent to an uphole end 326 of the upper end ring 204 in the run-in position. However, as set forth in greater detail below, the sleeve wall 318 may be configured to move in the axially uphole direction 308 to the stroked position (e.g., a position adjacent the downhole surface 312 of the upper chamber ring 314) during operation of the tool. Further, the sleeve wall 318 may extend radially inward such that the sleeve wall 318 may seal against the body portion 200. In particular, a radially inner surface 330 of the sleeve wall 318 may be configured to seal against the radially outer surface 310 of the body portion 200 via at least one sleeve wall seal 332 secured to the radially inner surface 330 of the sleeve wall 318. The sleeve wall seal 332 is configured to contact the radially outer surface 310 of the body portion 200 to maintain a seal between the sleeve wall 318 and the body portion 200 as the sleeve wall 318 moves along the body portion 200.

Accordingly, the chamber 300 may be fully sealed to prevent the compressible fluid from flowing out of the chamber 300 via the seal formed between the upper chamber ring 314 and the body portion 200, the seal formed between the upper chamber ring 314 and the sleeve 208, and the seal between the sleeve wall 318 and the body portion 200. Indeed, the hydrostatic assist chamber 300 may be sealed such that it maintains atmospheric pressure within the chamber 300.

Due to the pressure differential between the wellbore 104 and the hydrostatic assist chamber 300 (e.g., the wellbore pressure being greater than the pressure in the hydrostatic assist chamber 300), forces on the hydrostatic assist chamber 300 may bias the sleeve 208 to move in the axially uphole direction 308 with respect to the body portion 200. In particular, the sleeve wall 318 of the sleeve 208 may be biased to move in the axially uphole direction 308 toward the upper chamber ring 314 to reduce the volume of the hydrostatic assist chamber 300; thereby, reducing the pressure differential. As set forth above, this biasing force is configured to help fully stroke the sleeve 208 from the run-in position to the stroked position. However, in the run-in position, the at least one fastener 220 may restrain axial movement of the sleeve 208 and sleeve wall 318 with respect to the body portion 200. The biasing force from the pressure differential may be insufficient to shear the at least one fastener 220 as the shifting sleeve tieback seal system 120 is run-in hole.

FIG. 3B illustrates the shifting sleeve tieback seal system 120 in the set position and the hydrostatic assist chamber 300 disposed in the stroked position (e.g., a position with the sleeve 208 axially shifted such that the sleeve 208 is completely axially offset from the swellable material 202). Indeed, the sleeve 208 may be positioned axially uphole from the upper end 302 of the swellable material 202 in the stroked position such that expansion of the swellable material 202 is not restrained by the sleeve 208. As set forth above, the swellable material 202 is configured to expand in response to exposure to wellbore fluid. In the run-in position, the sleeve 208 prevents wellbore fluid from contacting the swellable material 202 such that the swellable material 202 does not expand prematurely. However, in the stroked position, the swellable material 202 is exposed to the wellbore 104 such that swellable material 202 may react and expand to form a seal (e.g., tieback seal) at the liner hanger 112, liner 108, and/or casing 102. As illustrated, the swellable material 202 is expanded to form a seal against the liner hanger 112. Moreover, with the swellable material 202 sealed against the liner hanger 112, production fluid may be directed to flow from the liner 108 to the liner tieback 116 via the shifting sleeve tieback seal system 120.

The sleeve 208 may shift from the run-in position to the stroked position in response to the shifting sleeve tieback seal system 120 engaging the downhole feature with suitable geometry (e.g., the liner hanger 112, the liner 108, etc.) in a setting position. As set forth above, the at least one fastener 220 may restrain axial movement of the sleeve 208 and sleeve wall 318 with respect to the body portion 200 in the run in position. Further, the biasing force generated from the pressure differential between the hydrostatic assist chamber 300 and the wellbore 104 may be insufficient to shear the at least one fastener 220 (e.g., the lower shear pin 224) as the shifting sleeve tieback seal system 120 is run-in hole. However, in the setting position, the engagement between the sleeve 208 and the downhole feature (e.g., the liner hanger 112) may be configured to shear the at least one fastener 220 such that the sleeve 208 may shift from the run-in position to the stroked position. In particular, as the tool (e.g., shifting sleeve tieback seal system 120) moves axially downhole toward the set position (as shown), the sleeve 208 first contacts the top surface 234 of the liner hanger 112 in a setting position. Such contact with the liner hanger 112 may apply sufficient force to the sleeve 208 to shear the at least one fastener 220 such that the hydrostatic assist chamber 300 may drive the sleeve 208 from the run-in position to the stroked position.

In particular, the contact between the sleeve 208 and the top surface 234 of the liner hanger 112 may prevent the sleeve 208 from moving further in the axially downhole direction 236 with respect to the liner hanger 112. However, the weight on the shifting sleeve tieback seal system 120, at least in part from the weight of the liner tieback 116, may drive the body portion 200, the swellable material 202, the upper chamber ring 314, and the end rings 204, 206 of the shifting sleeve tieback seal system 120 in the downhole direction with respective to the liner hanger 112. As such, the weight on the tool may shear the at least one fastener 220 securing the sleeve 208 to the lower end ring 206 and/or the upper end ring 204 such that the sleeve 208 detaches from the lower end ring 206 and/or the upper end ring 204. With the sleeve 208 detached, the body portion 200, the end rings 204, 206, and the swellable material 202 may move axially downhole with respect to the sleeve 208 into the central liner hanger bore 238 of the liner hanger 112. As the body portion 200 moves axially downhole, continued contact between the sleeve 208 and the liner hanger 112 may drive the sleeve 208 from the run-in position to the stroked position. However, as set forth above, the hydrostatic assist chamber 300 may help to drive the sleeve 208 axially upward to a fully stroked position. For example, as set forth above, the swellable material 202 may have a greater axial length than the polished bore receptacle 304 of the liner hanger 112. As such, the shifting sleeve tieback seal system 120 may bottom out at the downhole end 306 of the liner hanger 112 before the sleeve 208 is fully stroked. However, the hydrostatic assist chamber 300 may continue to drive the sleeve 208 axially upward, with respect to the body portion 200, to the fully stroked position. Alternatively, the hydrostatic assist chamber 300 may drive the sleeve 208 from the run-in position to the stroked position independent of the liner hanger 112 once the at least one fastener 220 is sheared.

Moreover, in the run-in position, the sleeve wall 318 of the sleeve 208 may be secured in the run-in position (e.g., in a position adjacent to the uphole end 326 of the upper end ring 204). In response to shearing of the at least one fastener 220, the sleeve 208 may be released to slide axially with respect to the body portion 200, the upper end ring 204, and the upper chamber ring 314. With the sleeve 208 released, the biasing force from pressure differential between the hydrostatic assist chamber 300 and wellbore 104 may drive the sleeve wall 318 to move from the run-in position to the stroked position. As illustrated, the sleeve wall 318 may be positioned adjacent to the downhole surface 312 of the upper chamber ring 314 in the fully stroked position. The hydrostatic assist chamber 300 may drive the sleeve wall 318 to move toward the upper chamber ring 314 until the pressure in the chamber 300 equalizes with the wellbore pressure outside of the chamber 300. However, due to the disparity of the pressure in the chamber 300 in the run-in position in comparison with the wellbore pressure, the fully stroked position of the sleeve 208 may position the sleeve wall 318 proximate the upper chamber ring 314 as shown.

Moreover, the distance between the sleeve wall 318 in the run-in position and the upper chamber ring 314 may determine the stroke length of the sleeve 208. Accordingly, the distance between the sleeve wall 318 in the run-in position and the upper chamber ring 314 may be greater than the axial length of the swellable material 202 such that the sleeve 208 may be moved to a position completely axially offset from the swellable material 202. That is the stroke length may be sufficient such that the sleeve 208 may be positioned axially uphole from the upper end 302 of the swellable material 202 in the stroked position such that expansion of the swellable material 202 is not restrained by the sleeve 208.

Figure 4A:
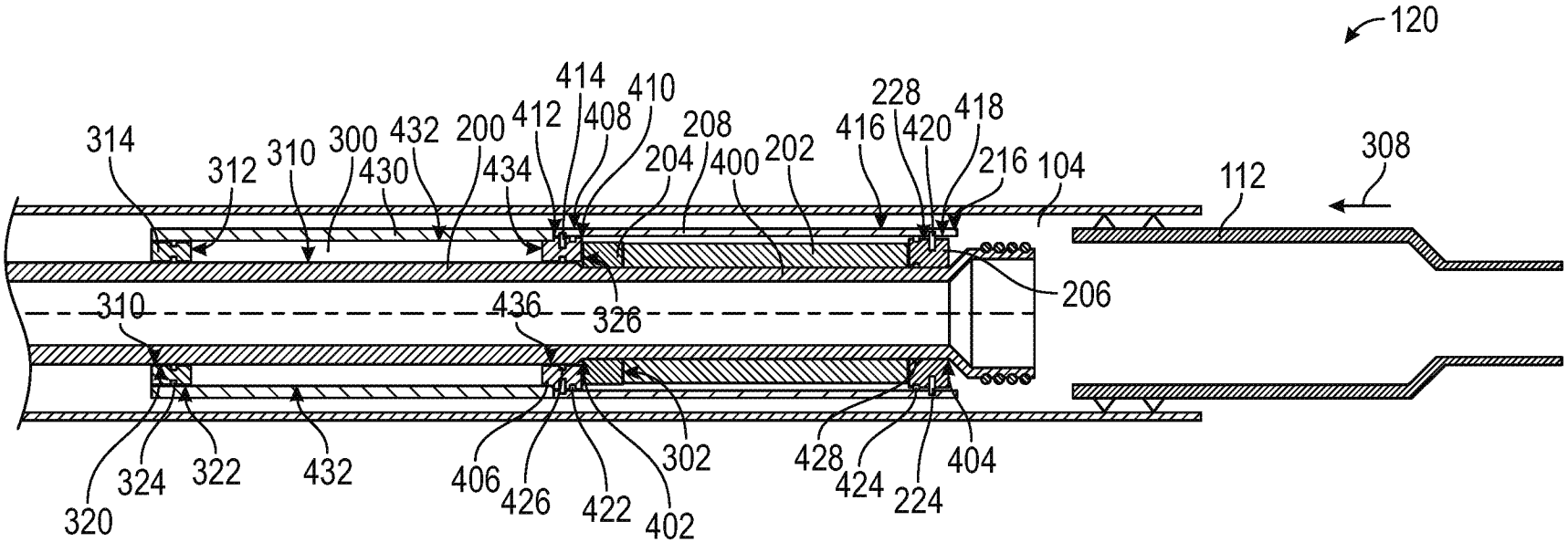
FIGS. 4A-4C illustrate cross-sectional views of a shifting sleeve tieback seal system sealing against casing and a liner hanger, in accordance with some embodiments of the present disclosure.
Figure 4B:
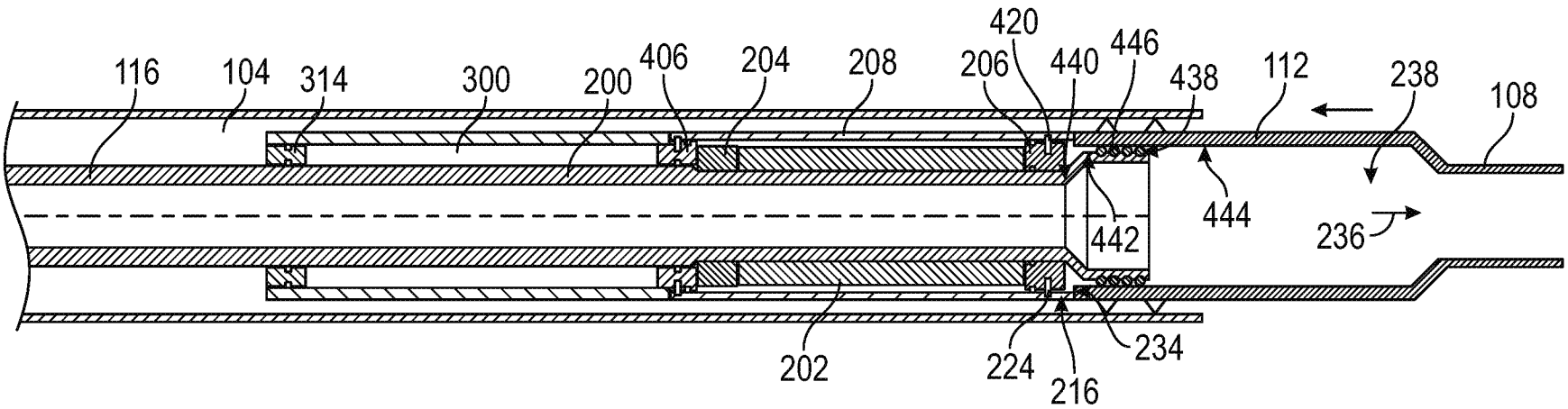
Figure 4C:
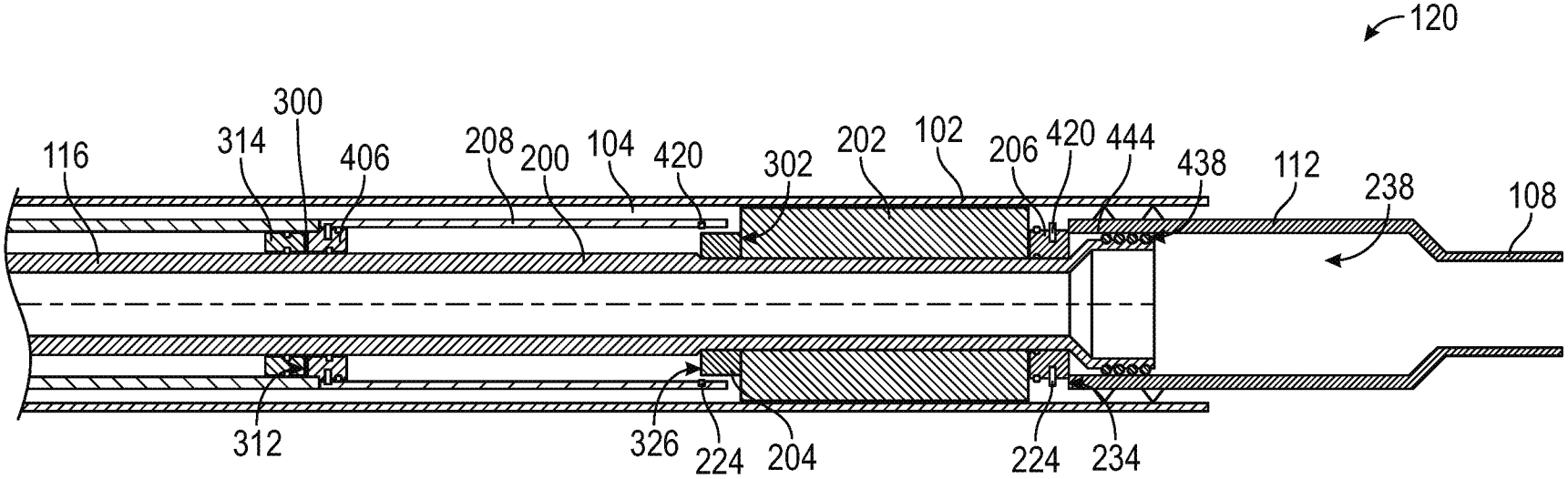

FIGS. 4A-4C illustrate cross-sectional views of a shifting sleeve tieback seal system sealing against casing and a liner hanger, in accordance with some embodiments of the present disclosure. In particular, FIG. 4A illustrates the shifting sleeve tieback seal system 120 with a hydrostatic assist chamber 300 disposed in the run-in-position. As set forth above, the shifting sleeve tieback seal system 120 comprises the body portion 200 and a swellable material 202 disposed about the circumference of the body portion 200. In particular, the swellable material 202 may be disposed between the upper end ring 204 and the lower end ring 206, which are each disposed about the body portion 200. The upper end ring 204 may be positioned uphole from the lower end ring 206. Moreover, the body portion 200 may comprise a recessed portion 400 (e.g., a span of the body portion 200 with a reduced outer diameter). As illustrated, the upper end ring 204 and the lower end ring 206 may be secured about the recessed portion 400. The recessed portion 400 may help restrain axial movement of the upper end ring 204 and the lower end ring 206. For example, an upper end 402 of the recessed portion 400 may contact the upper end ring 204 to restrain axially uphole movement of the upper end ring 204, and a lower end 404 of the recessed portion 400 may contact the lower end ring 206 to restrain axially downhole movement of the lower end ring 206.

Moreover, the swellable material 202 may be disposed about the recessed portion 400 in a position between the upper end ring 204 and the lower end ring 206. The upper end ring 204 and the lower end ring 206 may be configured to support the swellable material 202 (e.g., restrain axial movement of the swellable material 202 with respect to the body portion 200) as the shifting sleeve tieback seal system 120 is run-in-hole and secured in the set position. As set forth above, the swellable material 202 may be configured to expand in response to exposure to wellbore fluids. The upper end ring 204 and the lower end ring 206 may restrain expansion of the swellable material 202 in axial directions such that the swellable material 202 may expand further in a radial direction. However, as set forth above, the shifting sleeve tieback seal system 120 may also include the sleeve 208 configured to isolate the swellable material 202 from the wellbore fluid in the run-in position to prevent the swellable material 202 from prematurely expanding in the wellbore 104.

The sleeve 208 may have a tubular shape that is disposed about the swellable material 202 in the run-in position. Additionally, the sleeve 208 may be disposed about the lower end ring 206, the upper end ring 204, and a lower chamber ring 406. As illustrated, an upper portion 408 of the sleeve 208 may be secured to the lower chamber ring 406. Specifically, a radially inner surface 410 of the upper portion 408 of the sleeve 208 may be secured to the radially outer surface 412 of the lower chamber ring 406 via at least one set screw 414, or any other suitable fastener, to rigidly secure the sleeve 208 to the lower chamber ring 406. Further, a lower portion 416 of the sleeve 208 may be secured to the lower end ring 206. Specifically, a radially inner surface 418 of the lower portion 416 of the sleeve 208 may be secured to the radially outer surface 228 of the lower end ring 206 via at least one shearable member 420 (e.g., the lower shear pin 224) to rigidly secure the sleeve 208 to the lower end ring 206 in the run-in position. The lower end ring 206 may also be rigidly secured to the body portion 200 such that movement of the sleeve 208, with respect to the body portion 200, is restrained in the run-in position. Additionally, the upper portion 408 of the sleeve 208 may be sealed against the lower chamber ring 406 via an upper enclosure seal 422, the lower portion 416 of the sleeve 208 may be sealed against the lower end ring 206 via an outer lower enclosure seal 424, the lower chamber ring 406 may be sealed against the body portion 200 via a lower chamber seal 426, and the lower end ring 206 may be sealed against the recessed portion 400 via an inner lower enclosure seal 428 such that the swellable material 202 may be isolated/sealed from the wellbore fluid in the run-in position.

However, as set forth in greater detail below, the sleeve 208 may be displaced axially upward in the set position such that the swellable material 202 may be exposed to the wellbore fluids at a desired location in the wellbore 104. The lower end 216 of the sleeve 208 may be configured to engage the downhole feature with suitable geometry (e.g., the liner hanger 112, the liner 108, etc.) in the setting position. For example, the lower end 216 of the sleeve 208 may extend axially downhole from the lower end ring 206 in the run-in position such that the liner hanger 112 may engage the sleeve 208 before the lower end ring 206 lands on the liner hanger 112. Such engagement between the sleeve 208 and the liner hanger 112 may shear the at least one shearable member 420 (e.g., the lower shear pin 224) such that the sleeve 208 may shift from the run-in position to the stroked position.

Further, the hydrostatic assist chamber 300 is configured to provide a biasing force to help fully stroke the sleeve 208 from a run-in position to a stroked position. Alternatively, or additionally, the shifting sleeve tieback seal system 120 may include a biasing mechanism (e.g., springs, mechanical actuators, etc.) to help fully stroke the sleeve 208. Moreover, the hydrostatic assist chamber 300 is configured to help fully stroke the sleeve 208 such that the lower end 216 of the sleeve 208 is shifted from a position radially outward and axially aligned with the swellable material 202 (e.g., the run-in position) to a position axially uphole from the upper end 302 of the swellable material 202 (e.g., the stroked position). The hydrostatic assist chamber 300 may be configured to drive the sleeve 208 axially upward, with respect to the body portion 200, to the fully stroked position in response to shearing of the at least one shearable member 420 (e.g., the at least one lower shear pin 224). Further, after the at least one shearable member 420 is sheared, the hydrostatic assist chamber 300 may be configured to fully stroke the sleeve 208 without additional forces generated by contact between the sleeve 208 and the liner hanger 112.

The hydrostatic assist chamber 300 includes a chamber 300 for housing a compressible fluid (e.g., air) at atmospheric pressure. As illustrated, the chamber 300 may be disposed axially above the swellable material 202 and radially between a chamber sleeve 430 and the body portion 200. For example, the chamber 300 may be defined by a radially inner surface 432 of the chamber sleeve 430, the radially outer surface 310 of the body portion 200, the downhole surface 312 of an upper chamber ring 314, and an uphole surface 434 of the lower chamber ring 406. The upper chamber ring 314 may have a hollow cylindrical shape and may be disposed about the body portion 200 in a position axially uphole from the upper end ring 204. The upper chamber ring 314 may be rigidly secured to the body portion 200 such that the upper chamber ring 314 maintains a fixed distance from the upper end ring 204 during operation. Further, the radially inner surface 320 of the upper chamber ring 314 may be secured against the radially outer surface 310 of the body portion 200 such that the upper chamber ring 314 is sealed against the body portion 200 to prevent the compressible fluid from flowing out of the chamber 300. Additionally, the radially outer surface 322 of the upper chamber ring 314 may be sealed against the radially inner surface 432 of the chamber sleeve 430 to prevent the compressible fluid from flowing out of the chamber 300. In particular, the at least one upper chamber ring seal 324 may be secured to the radially outer surface 322 of the upper chamber ring 314, and the at least one upper chamber ring seal 324 may be configured to contact the radially inner surface 432 of the chamber sleeve 430 to maintain a seal between the upper chamber ring 314 and the chamber sleeve 430 as the chamber sleeve 430 moves with respect to the upper chamber ring 314.

The chamber sleeve 430 may be rigidly secured to and sealed against the lower chamber ring 406. In particular, at least the radially inner surface 432 of the chamber sleeve 430 may be rigidly secured to and sealed against a radially outer surface 412 of the lower chamber ring 406 to prevent the compressible fluid from flowing out of the chamber 300. Further, the sleeve 208 may be rigidly secured to the lower chamber ring 406. As such, movement of the sleeve 208 via contact with the liner hanger 112 may drive movement of the lower chamber ring 406 and the chamber sleeve 430. Moreover, the lower chamber ring 406 may comprise a hollow cylindrical shape that is disposed about the body portion 200. Additionally, the lower chamber ring 406 may be disposed adjacent to the uphole end 326 of the upper end ring 204 in the run-in position. However, the lower chamber ring 406 may be configured to move in the axially uphole direction 308 to the stroked position (e.g., a position adjacent a downhole surface 312 of the upper chamber ring 314) during operation of the tool. Further, the lower chamber ring 406 may be sealed against the body portion 200. That is, a radially inner surface 436 of the lower chamber ring 406 may be configured to seal against the radially outer surface 310 of the body portion 200 via at the least one lower chamber seal 426 secured to the radially inner surface 436 of the lower chamber ring 406. The lower chamber seal 426 is configured to contact the radially outer surface 310 of the body portion 200 to maintain a seal between the lower chamber ring 406 and the body portion 200 as the lower chamber ring 406 moves along the body portion 200 to prevent the compressible fluid from flowing out of the chamber 300.

Accordingly, the chamber 300 may be fully sealed to prevent the compressible fluid from flowing out of the chamber 300 via the seal formed between the upper chamber ring 314 and the body portion 200, the seal formed between the upper chamber ring 314 and the chamber sleeve 430, the seal formed between the chamber sleeve 430 and lower chamber ring 406, and the seal formed between the lower chamber ring 406 and the body portion 200. Indeed, the hydrostatic assist chamber 300 may be sealed such that it maintains atmospheric pressure within the chamber 300.

Due to the pressure differential between the wellbore 104 and the hydrostatic assist chamber 300 (e.g., the wellbore pressure being greater than the pressure in the hydrostatic assist chamber 300), forces on the hydrostatic assist chamber 300 may bias the lower chamber ring 406 to move in the axially uphole direction 308 with respect to the body portion 200. In particular, lower chamber ring 406 may be biased to move in the axially uphole direction 308 toward the upper chamber ring 314 to reduce the volume of the hydrostatic assist chamber 300; thereby, reducing the pressure differential. As the sleeve 208 is rigidly secured to the lower chamber ring 406, this biasing force is configured to help fully stroke the sleeve 208 from the run-in position to the stroked position. However, in the run-in position, the at least one shearable member 420 may restrain axial movement of the sleeve 208 and the lower chamber ring 406 with respect to the body portion 200. The biasing force from the pressure differential may be insufficient to shear the at least one shearable member 420 as the shifting sleeve tieback seal system 120 is run-in hole.

FIG. 4B illustrates the shifting sleeve tieback seal system 120 in the setting position and the hydrostatic assist chamber 300 disposed in the run-in position. As illustrated, the shifting sleeve tieback seal system 120 may include a sealing assembly 438 extending from a downhole end 440 of the body portion 200. The sealing assembly 438 may have a tubular shape with a larger diameter than the body portion 200. In particular, the diameter of a radially outer surface 442 of the sealing assembly 438 may be substantially similar to the diameter of the radially inner surface 444 of the liner hanger 112 such that the sealing assembly 438 may be sealed against the radially inner surface 444 of the liner hanger 112. Further, the sealing assembly 438 may include a plurality of seals 446 secured to the radially outer surface 442 of the sealing assembly 438. Indeed, as illustrated, the sealing assembly 438 may be run into the central liner hanger bore 238 of the liner hanger 112 in the setting position such that the plurality of seals 446 may seal the sealing assembly 438 against the liner hanger 112. With the sealing assembly 438 sealed against the liner hanger 112, production fluid flowing up from the liner 108 may flow into the liner tieback 116 without leaking into the wellbore 104.

Moreover, the sleeve 208 may be configured to engage the liner hanger 112 in the setting position. The sleeve 208 may shift from the run-in position to the stroked position in response to the shifting sleeve tieback seal system 120 engaging the liner hanger 112 in a setting position. As set forth above, the at least one shearable member 420 (e.g., the lower shear pin 224) the at least one may restrain axial movement of the sleeve 208 and the lower chamber ring 406 with respect to the body portion 200 in the run-in position. Further, the biasing force generated from the pressure differential between the hydrostatic assist chamber 300 and the wellbore 104 may be insufficient to shear the at least one shearable member 420 as the shifting sleeve tieback seal system 120 is run-in hole. However, in the setting position, the engagement between the sleeve 208 and the liner hanger 112 may be configured to shear the at least one shearable member 420 such that the sleeve 208 may shift from the run-in position to the stroked position. In particular, as the tool (e.g., shifting sleeve tieback seal system 120) moves axially downhole toward the set position, the lower end 216 of the sleeve 208 first contacts the top surface 234 of the liner hanger 112 in a setting position. Such contact with the liner hanger 112 may apply sufficient force to the sleeve 208 shear the at least one shearable member 420. With the at least one shearable member 420 sheared, the biasing force from the hydrostatic assist chamber may drive the sleeve 208 from the run-in position to the stroked position.

In particular, the contact between the sleeve 208 and the top of the liner hanger 112 may prevent the sleeve 208 from moving further in the axially downhole direction 236 with respect to the liner hanger 112. However, the weight on the shifting sleeve tieback seal system 120, at least in part from the weight of the liner tieback 116, may drive the body portion 200, the swellable material 202, the lower end ring 206, the upper end ring 204, and the upper chamber ring 314 of the shifting sleeve tieback seal system 120 in the axially downhole direction 236 with respective to the liner hanger 112. As such, the weight on the tool may shear the at least one shearable member 420 securing the sleeve 208 to the lower end ring 206 such that the sleeve 208 detaches from the lower end ring 206.

FIG. 4C illustrates the shifting sleeve tieback seal system 120 in the set position and the hydrostatic assist chamber 300 disposed in the stroked position (e.g., a position with the sleeve axially shifted such that the sleeve 208 is completely axially offset from the swellable material 202). Indeed, the sleeve 208 may be positioned axially uphole from the upper end 302 of the swellable material 202 in the stroked position such that expansion of the swellable material 202 is not restrained by the sleeve 208. As set forth above, the swellable material 202 is configured to expand in response to exposure to wellbore fluid. In the run-in position, the sleeve 208 prevents wellbore fluid from contacting the swellable material 202 such that the swellable material 202 does not expand prematurely. However, in the stroked position, the swellable material 202 is exposed to the wellbore 104 such that swellable material 202 may react and expand to form a seal (e.g., tieback seal) against the liner hanger 112, liner 108, and/or casing 102. As illustrated, the swellable material 202 is expanded to form a seal against the casing 102. Moreover, with the swellable material 202 sealed against the casing 102 and the sealing assembly 438 sealed against the liner hanger 112, production fluid may be directed to flow from the liner 108 to the liner tieback 116 via the shifting sleeve tieback seal system 120.

Moreover, as set forth above, the at least one shearable member 420 (e.g., the lower shear pin 224) securing the sleeve 208 to the lower end ring 206 may be sheared in the setting position such that the sleeve 208 detaches from the lower end ring 206. With the sleeve 208 detached, the body portion 200, the upper chamber ring 314, the lower end ring 206, the upper end ring 204, and the swellable material 202 may move axially with respect to the sleeve 208 into the central liner hanger bore 238 of the liner hanger 112 until the lower end ring 206 lands on the top surface 234 of the liner hanger 112. Alternatively, engagement of the sealing assembly 438 with the radially inner surface 444 of the liner hanger 112 and/or expansion of the swellable material 202 may set the shifting sleeve tieback seal system 120 before the lower end ring 206 lands on the liner hanger 112. Further, once the at least one shearable member 420 is sheared and the sleeve 208 is released, the hydrostatic assist chamber 300 may drive the sleeve 208 axially upward to the fully stroked position. Indeed, the hydrostatic assist chamber 300 may drive the sleeve 208 from the run-in position to the stroked position independent of other biasing forces.

In the run-in position, the lower chamber ring 406 of the sleeve 208 may be secured in a position adjacent to the uphole end 326 of the upper end ring 204. In response to shearing of the at least one shearable member 420, the sleeve 208 may be released to slide axially with respect to the upper chamber ring 314. As the lower chamber ring 406 is rigidly secured to the sleeve 208, the lower chamber ring 406 may also be released to slide axially with respect to the upper chamber ring 314 in response to the at least one shearable member 420 being sheared. With the lower chamber ring 406 released, the biasing force from pressure differential between the hydrostatic assist chamber 300 and wellbore 104 may drive the lower chamber ring 406 to move from the run-in position to the stroked position. As illustrated, the lower chamber ring 406 may be positioned adjacent to the downhole surface 312 of the upper chamber ring 314 in the fully stroked position. The hydrostatic assist chamber 300 may drive the lower chamber ring 406 to move toward the upper chamber ring 314 until the pressure in the chamber 300 equalizes with the wellbore pressure outside of the chamber 300. However, due to the disparity of the pressure in the chamber 300 in the run-in position in comparison with the wellbore pressure, the fully stroked position of the lower chamber ring 406 may position the lower chamber ring 406 proximate the upper chamber ring 314 as shown.

Moreover, the distance between the lower chamber ring 406 in the run-in position and the upper chamber ring 314 may determine the stroke length of the sleeve 208. Accordingly, the distance between the lower chamber ring 406 in the run-in position and the upper chamber ring 314 may be greater than the axial length of the swellable material 202 such that the sleeve 208 may be moved to a position completely axially offset from the swellable material 202. That is the stroke length may be sufficient such that the sleeve 208 may be positioned axially uphole from the upper end 302 of the swellable material 202 in the stroked position such that expansion of the swellable material 202 is not restrained by the sleeve 208.

Accordingly, the present disclosure may provide a shifting sleeve tieback seal system configured to form a seal with a corresponding liner by axially shifting a sleeve in response to contact with a liner hanger such that a swellable material may expand to form the seal.

Statement 1. A shifting sleeve tieback seal system, comprising: a body portion; a swellable material disposed about a circumference of the body portion, wherein the swellable material is configured to expand in response to exposure to wellbore fluids; an upper end ring disposed about the body portion in a position axially above the swellable material; a lower end ring disposed about the body portion in a position axially below the swellable material; and a sleeve disposed radially outward from the swellable material and sealed against the upper end ring and/or the lower end ring in a run-in position to isolate the swellable material from wellbore fluids, wherein the sleeve is configured to contact a downhole feature in a setting position, and wherein contact with the downhole feature is configured to move the sleeve to expose the swellable material to wellbore fluids such that the swellable material expands to seal against a downhole tubular.

Statement 2. The shifting sleeve tieback seal system of statement 1, wherein the downhole feature comprises a liner hanger.

Statement 3. The shifting sleeve tieback seal system of statement 1 or statement 2, wherein the swellable material is configured to chemically react with the wellbore fluids, and wherein the chemical reaction causes the swellable material to expand.

Statement 4. The shifting sleeve tieback seal system of statement 1 or statement 2, wherein the swellable material is configured to absorb a portion of the wellbore fluids, and wherein absorbing the portion of the wellbore fluids is configured to cause the swellable material to expand.

Statement 5. The shifting sleeve tieback seal system of any preceding statement, further comprising at least one seal disposed between the sleeve and the upper end ring and/or the lower end ring in the run-in position.

Statement 6. The shifting sleeve tieback seal system of any preceding statement, wherein a distal end of the sleeve is configured to extend axially downhole from the lower end ring in the run-in position.

Statement 7. The shifting sleeve tieback seal system of any preceding statement, wherein the sleeve is secured to the upper end ring and/or the lower end ring in the run-in-position via at least one fastener.

Statement 8. The shifting sleeve tieback seal system of any preceding statement, wherein the at least one fastener comprises at least one shear pin.

Statement 9. The shifting sleeve tieback seal system of any preceding statement, wherein contact between a distal end of the sleeve and the downhole feature in the setting position is configured to shear the at least one fastener to release the sleeve to move with respect to the upper end ring and/or the lower end ring in response to movement of the body portion with respect to the downhole feature.

Statement 10. The shifting sleeve tieback seal system of any preceding statement, further comprising a hydrostatic assist chamber configured to drive the sleeve axially upward with respect to the body portion and/or the downhole feature to a set position.

Statement 11. The shifting sleeve tieback seal system of any preceding statement, wherein the hydrostatic assist chamber is formed between a radially outer surface of the body portion, a radially inner surface of a chamber sleeve, an upper chamber ring, and a lower chamber ring.

Statement 12. The shifting sleeve tieback seal system of any preceding statement, wherein the chamber sleeve is rigidly secured to the lower chamber ring, and wherein the chamber sleeve and the lower chamber ring are configured to move axially with respect to the upper chamber ring.

Statement 13. The shifting sleeve tieback seal system of any preceding statement, wherein the hydrostatic assist chamber is configured to house a compressible fluid at atmospheric pressure in the run-in-position, wherein a pressure differential between the hydrostatic assist chamber and the wellbore is configured to bias the lower chamber ring axially toward the upper chamber ring.

Statement 14. The shifting sleeve tieback seal system of any preceding statement, wherein an upper portion of the sleeve is secured to the lower chamber ring, wherein a lower portion of the sleeve is secured to the lower end ring via a fastener in the run in position, and wherein the lower end ring is rigidly secured to the body portion such that movement of the lower chamber ring toward the upper chamber ring is restrained in the run-in position.

Statement 15. The shifting sleeve tieback seal system of any preceding statement, further comprising a biasing mechanism configured to drive the sleeve axially upward with respect to the body portion and/or the downhole feature to a set position.

Statement 16. The shifting sleeve tieback seal system of any preceding statement, wherein the swellable material expands to seal against the downhole tubular, and wherein the downhole tubular comprises a liner, a liner hanger, a polished bore receptable, a casing, or some combination thereof.

Statement 17. A shifting sleeve tieback seal system, comprising: a body portion; a swellable material disposed about a circumference of the body portion, wherein the swellable material is configured to expand in response to exposure to wellbore fluids; an upper end ring disposed about the body portion in a position axially above the swellable material; a lower end ring disposed about the body portion in a position axially below the swellable material, wherein the upper end ring and the lower end ring are configured to restrain axial expansion of the swellable material; a lower chamber ring disposed about the body portion in a position axially above the lower end ring; an upper chamber ring disposed about the body portion in a position axially above the lower chamber ring; a sleeve secured and sealed against the lower end ring and the lower chamber ring in a run-in position to isolate the swellable material from wellbore fluids, wherein the sleeve is secured to the lower end ring via at least one shearable member, wherein the sleeve is configured to contact a liner hanger in a setting position, and wherein contact with the liner hanger is configured to shear the at least one shearable member to release the sleeve and lower chamber ring to move and expose the swellable material to wellbore fluids; a hydrostatic assist chamber formed between a radially outer surface of the body portion, a radially inner surface of a chamber sleeve, the lower chamber ring, and the upper chamber ring, wherein the hydrostatic assist chamber is configured to house a compressible fluid at atmospheric pressure in the run-in-position, and wherein a pressure differential between the hydrostatic assist chamber and the wellbore is configured to drive the lower chamber ring axially toward the upper chamber ring and move the sleeve axially upward with respect to the body portion and the liner hanger to a set position, wherein the set position is axially offset from the swellable material.

Statement 18. The shifting sleeve tieback seal system of statement 17, wherein the swellable material is configured to chemically react with the wellbore fluids, and wherein the chemical reaction causes the swellable material to expand.

Statement 19. The shifting sleeve tieback seal system of statement 17 or statement 18, wherein the swellable material is configured to absorb a portion of the wellbore fluids, and wherein absorbing the portion of the wellbore fluids is configured to cause the swellable material to expand.

Statement 20. A method, comprising: running a shifting sleeve tieback seal system into a wellbore toward a liner hanger, wherein the shifting sleeve tieback seal system comprises a body portion, a swellable material disposed about a circumference of the body portion and configured to expand in response to exposure to wellbore fluids, and a sleeve configured to isolate the swellable material from wellbore fluids in a run-in position; driving the sleeve into the liner hanger to shear at least one fastener holding the sleeve in the run-in position; moving the sleeve with respect to the body portion, via a hydrostatic assist chamber, from the run-in position to a set position in response to the at least one fastener being sheared; and expanding the swellable material to seal against a downhole tubular in response to movement of the sleeve exposing the swellable material to wellbore fluids.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Further-more, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A shifting sleeve tieback seal system, comprising:

a body portion;

a swellable material disposed about a circumference of the body portion, wherein the swellable material is configured to expand in response to exposure to wellbore fluids;

an upper end ring disposed about the body portion in a position axially above the swellable material;

a lower end ring disposed about the body portion in a position axially below the swellable material; and a sleeve disposed radially outward from the swellable material and sealed against the upper end ring and/or the lower end ring in a run-in position to isolate the swellable material from wellbore fluids, wherein the sleeve is configured to contact a downhole feature in a setting position, and wherein contact with the downhole feature is configured to move the sleeve to expose the swellable material to wellbore fluids such that the swellable material expands to seal against a downhole tubular, and wherein the sleeve is secured to the upper end ring and/or the lower end ring in the run-in position via at least one fastener.

2. The shifting sleeve tieback seal system of claim 1, wherein the downhole feature comprises a liner hanger.

3. The shifting sleeve tieback seal system of claim 1, wherein the swellable material is configured to chemically react with the wellbore fluids, and wherein the chemical reaction causes the swellable material to expand.

4. The shifting sleeve tieback seal system of claim 1, wherein the swellable material is configured to absorb a portion of the wellbore fluids, and wherein absorbing the portion of the wellbore fluids is configured to cause the swellable material to expand.

5. The shifting sleeve tieback seal system of claim 1, further comprising at least one seal disposed between the sleeve and the upper end ring and/or the lower end ring in the run-in position.

6. The shifting sleeve tieback seal system of claim 5, wherein a distal end of the sleeve is configured to extend axially downhole from the lower end ring in the run-in position.

7. The shifting sleeve tieback seal system of claim 1, wherein the at least one fastener comprises at least one shear pin.

8. The shifting sleeve tieback seal system of claim 1, wherein contact between a distal end of the sleeve and the downhole feature in the setting position is configured to shear the at least one fastener to release the sleeve to move with respect to the upper end ring and/or the lower end ring in response to movement of the body portion with respect to the downhole feature.

9. The shifting sleeve tieback seal system of claim 1, further comprising a hydrostatic assist chamber configured to drive the sleeve axially upward with respect to the body portion and/or the downhole feature to a set position.

10. The shifting sleeve tieback seal system of claim 9, wherein the hydrostatic assist chamber is formed between a radially outer surface of the body portion, a radially inner surface of a chamber sleeve, an upper chamber ring, and a lower chamber ring.

11. The shifting sleeve tieback seal system of claim 10, wherein the chamber sleeve is rigidly secured to the lower chamber ring, and wherein the chamber sleeve and the lower chamber ring are configured to move axially with respect to the upper chamber ring.

12. The shifting sleeve tieback seal system of claim 10, wherein the hydrostatic assist chamber is configured to house a compressible fluid at atmospheric pressure in the run-in position, wherein a pressure differential between the hydrostatic assist chamber and the wellbore is configured to bias the lower chamber ring axially toward the upper chamber ring.

13. The shifting sleeve tieback seal system of claim 12, wherein an upper portion of the sleeve is secured to the lower chamber ring, wherein a lower portion of the sleeve is secured to the lower end ring via the at least one fastener in the run-in position, and wherein the lower end ring is rigidly secured to the body portion such that movement of the lower chamber ring toward the upper chamber ring is restrained in the run-in position.

14. The shifting sleeve tieback seal system of claim 1, further comprising a biasing mechanism configured to drive the sleeve axially upward with respect to the body portion and/or the downhole feature to a set position.

15. The shifting sleeve tieback seal system of claim 1, wherein the swellable material expands to seal against the downhole tubular, and wherein the downhole tubular comprises a liner, a liner hanger, a polished bore receptable, a casing, or some combination thereof.

16. A shifting sleeve tieback seal system, comprising:

a body portion;

a swellable material disposed about a circumference of the body portion, wherein the swellable material is configured to expand in response to exposure to wellbore fluids;

an upper end ring disposed about the body portion in a position axially above the swellable material;

a lower end ring disposed about the body portion in a position axially below the swellable material, wherein the upper end ring and the lower end ring are configured to restrain axial expansion of the swellable material;

a lower chamber ring disposed about the body portion in a position axially above the lower end ring;

an upper chamber ring disposed about the body portion in a position axially above the lower chamber ring;

a sleeve secured and sealed against the lower end ring and the lower chamber ring in a run-in position to isolate the swellable material from wellbore fluids, wherein the sleeve is secured to the lower end ring via at least one shearable member, wherein the sleeve is configured to contact a liner hanger in a setting position, and wherein contact with the liner hanger is configured to shear the at least one shearable member to release the sleeve and lower chamber ring to move and expose the swellable material to wellbore fluids;

a hydrostatic assist chamber formed between a radially outer surface of the body portion, a radially inner surface of a chamber sleeve, the lower chamber ring, and the upper chamber ring, wherein the hydrostatic assist chamber is configured to house a compressible fluid at atmospheric pressure in the run-in position, and wherein a pressure differential between the hydrostatic assist chamber and the wellbore is configured to drive the lower chamber ring axially toward the upper chamber ring and move the sleeve axially upward with respect to the body portion and the liner hanger to a set position, wherein the set position is axially offset from the swellable material.

17. The shifting sleeve tieback seal system of claim 16, wherein the swellable material is configured to chemically react with the wellbore fluids, and wherein the chemical reaction causes the swellable material to expand.

18. The shifting sleeve tieback seal system of claim 16, wherein the swellable material is configured to absorb a portion of the wellbore fluids, and wherein absorbing the portion of the wellbore fluids is configured to cause the swellable material to expand.

19. A method, comprising:

running a shifting sleeve tieback seal system into a wellbore toward a liner hanger, wherein the shifting sleeve tieback seal system comprises a body portion, a swellable material disposed about a circumference of the body portion and configured to expand in response to exposure to wellbore fluids, and a sleeve configured to isolate the swellable material from wellbore fluids in a run-in position;

driving the sleeve into the liner hanger to shear at least one fastener holding the sleeve in the run-in position;

moving the sleeve with respect to the body portion, via a hydrostatic assist chamber, from the run-in position to a set position in response to the at least one fastener being sheared; and expanding the swellable material to seal against a downhole tubular in response to movement of the sleeve exposing the swellable material to wellbore fluids.

* * * * *